US010349721B2

(12) United States Patent
Lu

(10) Patent No.: US 10,349,721 B2
(45) Date of Patent: Jul. 16, 2019

(54) COSMETIC APPLICATOR WITH ROTARY CARTRIDGE

(71) Applicant: FASHION BEAUTY COSMETECH CO., LTD., Tainan (TW)

(72) Inventor: Hsiu-Ou Lu, Tainan (TW)

(73) Assignee: Fashion Beauty Cosmetech Co., Ltd., Tainan (TW)

( * ) Notice: Subject to any disclaimer, the term of this patent is extended or adjusted under 35 U.S.C. 154(b) by 171 days.

(21) Appl. No.: 15/392,229

(22) Filed: Dec. 28, 2016

(65) Prior Publication Data

US 2018/0177278 A1 Jun. 28, 2018

(51) Int. Cl.

| | |
|---|---|
| ***B43K 5/18*** | (2006.01) |
| ***B43K 7/10*** | (2006.01) |
| ***A45D 34/04*** | (2006.01) |
| ***B43K 8/12*** | (2006.01) |
| *A45D 34/00* | (2006.01) |
| *A45D 40/20* | (2006.01) |

(52) U.S. Cl.

CPC ..... *A45D 34/04* (2013.01); *B43K 5/1863* (2013.01); *B43K 8/12* (2013.01); *A45D 2034/005* (2013.01); *A45D 2040/208* (2013.01); *B43K 5/1827* (2013.01); *B43K 7/10* (2013.01)

(58) Field of Classification Search

CPC ..... B43K 5/1827; B43K 7/10
USPC ..... 401/132, 133, 205, 206, 219, 232
See application file for complete search history.

(56) References Cited

U.S. PATENT DOCUMENTS

| | | | | |
|---|---|---|---|---|
| 9,066,711 | B2 * | 6/2015 | Ruiz, Sr. | A46B 11/0075 |
| 2013/0251439 | A1 * | 9/2013 | Guzman | A61M 35/003 401/132 |

* cited by examiner

*Primary Examiner* — David J Walczak
*Assistant Examiner* — Joshua R Wiljanen
(74) *Attorney, Agent, or Firm* — Rosenberg, Klein & Lee

(57) ABSTRACT

A cosmetic applicator includes a body which includes a tip part and an extension which has a threaded portion. A case has a rotary member threadedly connected to the threaded portion. A contact member is received in the case which has a contact portion located corresponding to the shoulder of the body. A liquid supply unit is axially received in the body and the case, and has a liquid tube, a duct and a guide tube. The liquid tube contacts the contact member. The duct is inserted in the liquid tube and has a passage. A sealing member is removably located at the duct to seal or open the guide tube. A clip is connected to a groove between the case and the body before first use. The clip is removed and the case is rotated to move the sealing member to allow cosmetic liquid to reach the tip part.

10 Claims, 5 Drawing Sheets

COSMETIC APPLICATOR WITH ROTARY CARTRIDGE

BACKGROUND OF THE INVENTION

1. Fields of the Invention

The present invention relates to a cosmetic applicator with a rotary cartridge, and more particularly, to a cosmetic applicator wherein the liquid received therein evenly reaches the applicator by way of rotation and shaking when the applicator is first used.

2. Descriptions of Related Art

Generally speaking, makeup application is a common practice for people to maintain an appealing appearance. Among different types of cosmetic applicators, a cosmetic applicator with a space for receiving cosmetic liquid is needed.

The conventional cosmetic applicator known to applicant is a push-type applicator and generally comprises a body and a cap, wherein cosmetic material such as cosmetic liquid is received in a cartridge in the body. A button is connected to the rear end of the body and a tip part is connected to the front end of the body. A resilient member is located between the cartridge and the tip part. The user pushes the button to squeeze the cosmetic liquid out from the cartridge and reaches the tip part, and the user uses the tip part to apply the make up on her or his face. However, often the button is unintentionally pushed to squeeze a large amount of the cosmetic liquid that is absorbed in the tip part, and then may apply too much of the cosmetic liquid to the user's face: which is not a desired situation for the user.

The present invention intends to provide a cosmetic applicator with a rotary cartridge to eliminate the shortcomings mentioned above.

SUMMARY OF THE INVENTION

The present invention relates to a cosmetic applicator and comprises a body having a space defined axially therein. A tip part is connected to the first end of the body, and an extension extends from the second end of the body and has a threaded portion formed thereon. The body has a shoulder formed at the conjunction portion between the extension and the body, wherein the diameter of the shoulder is larger than that of the threaded portion. A case is connected to the body and has a room which communicates with the space of the body. A rotary member is threadedly connected to the threaded portion of the body. A contact member is received in the room of the case and which is a T-shaped member. The case has a contact portion which is located corresponding to the shoulder of the body.

A liquid supply unit is axially received in the space of the body and the room of the body. The liquid supply unit has a liquid tube, a duct and a guide tube having first and second ends. The liquid tube has the first end contacting the contact member and is located in the space of the body. The duct is inserted in an opening defined in the first end of the liquid tube. The duct has a passage defined axially therethrough. A sealing member is removably located at the first end of the duct that faces the first end of the liquid tube. The diameter of the sealing member is larger than an opening in the second end of the guide tube so as to seal or open the guide tube.

The tip part is connected to the first end of the guide tube, and the diameter of the second end of the tip part is smaller than the inner diameter of the passage. The second end of the tip part is located in the passage. The second end of the guide tube contacts the sealing member. The guide tube is longer than the duct.

When the body is located at an initial position, the sealing member seals the guide tube. When the case is rotated by rotating the rotary member along the threaded portion, and the distance between the shoulder and the contact portion is reduced to an open position, the sealing member is pushed by the guide tube and separated from the duct and located in the liquid tube.

Preferably, a groove is formed between the shoulder, the contact portion and the extension. A clip is engaged with the groove and has a hold portion which matches with the outer periphery of the extension to connect the clip to the extending. The top face and the bottom face of the hold portion respectively contact the shoulder and the contact portion.

Preferably, the clip is a C-shaped clip.

Preferably, the clip has a handle extending from the outside of the hold portion.

Preferably, the contact member and the case are a one-piece part.

Preferably, the distance between the shoulder and the contact portion is larger than the distance that the sealing member is removed from the passage.

Preferably, the contact member has a recess in which the liquid tube is inserted.

Preferably, a cap is axially connected to the first end of the body. The contact member is axially connected to the body.

Preferably, the liquid tube has a rod, and the diameter of the rod is smaller than the inner diameter of the passage.

Preferably, the duct has a flange formed on the second end thereof. The flange contacts the opening in the first end of the liquid tube.

The present invention has advantages which are that the clip is connected to the groove between the case and the body before first use. The clip functions as a safety device and prevents the user form unintentionally rotating or pushing the cosmetic applicator. The clip eliminates the shortcomings of the conventional cosmetic applicator mentioned above.

When using the cosmetic applicator of the present invention, for the first time, the clip is removed from the groove, and the rotary member is rotated relative to the threaded portion to move the case from the initial position to the open position. The contact member presses the liquid tube so that the liquid tube and the duct move toward the tip part. At the same time, the sealing member moves in the passage. The distance between the contact portion and the shoulder is larger than the distance that the sealing member is removed from the passage so that the sealing member is removed from the passage. The user then shakes the cosmetic applicator of the present invention and the sealing member unseals the guide tube, and the rod and the sealing member stir the cosmetic liquid, so that the cosmetic liquid in the liquid tube flows through the gap between the sealing member and the duct and flows to the tip part via the guide tube. The cosmetic liquid is evenly output from the tip part.

The contact member is a T-shaped member, so that the liquid tube can be firmly pushed to contact the recess to reduce the possibility of shaking or shifting. Therefore, the liquid tube is positioned stably and the rotation of the case is smooth and reliable.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
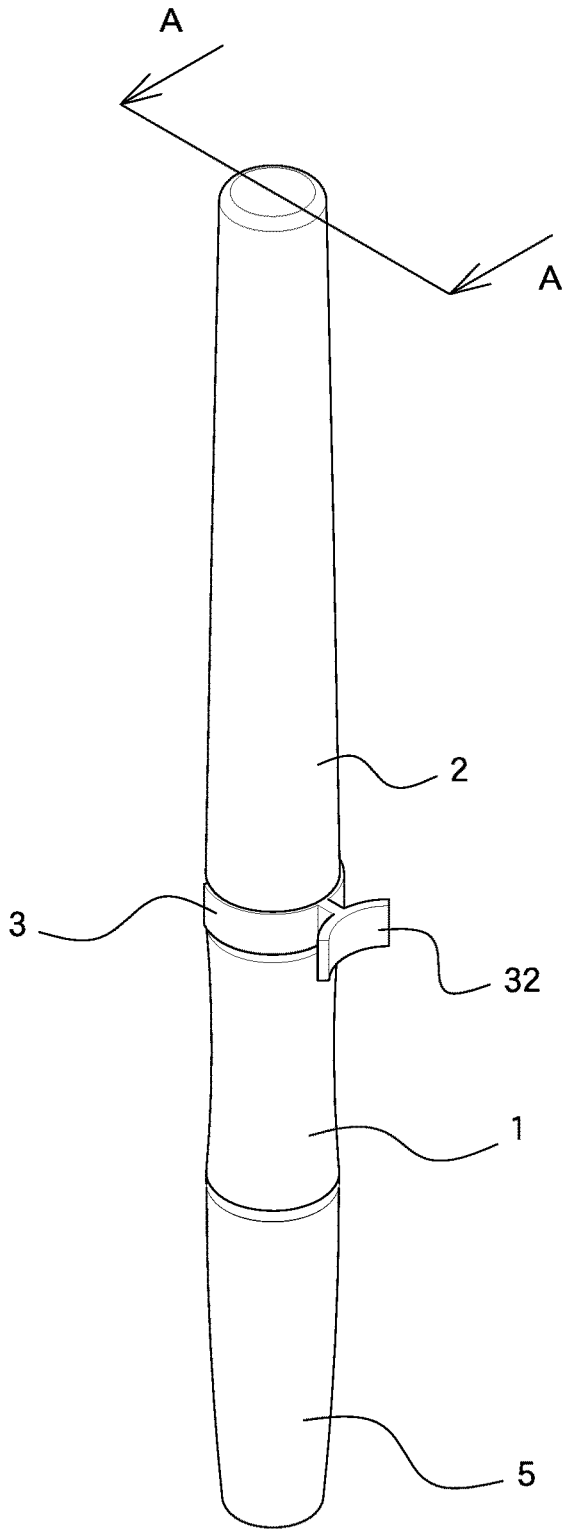
FIG. 1 is a perspective view to show the cosmetic applicator of the present invention.
Figure 2:
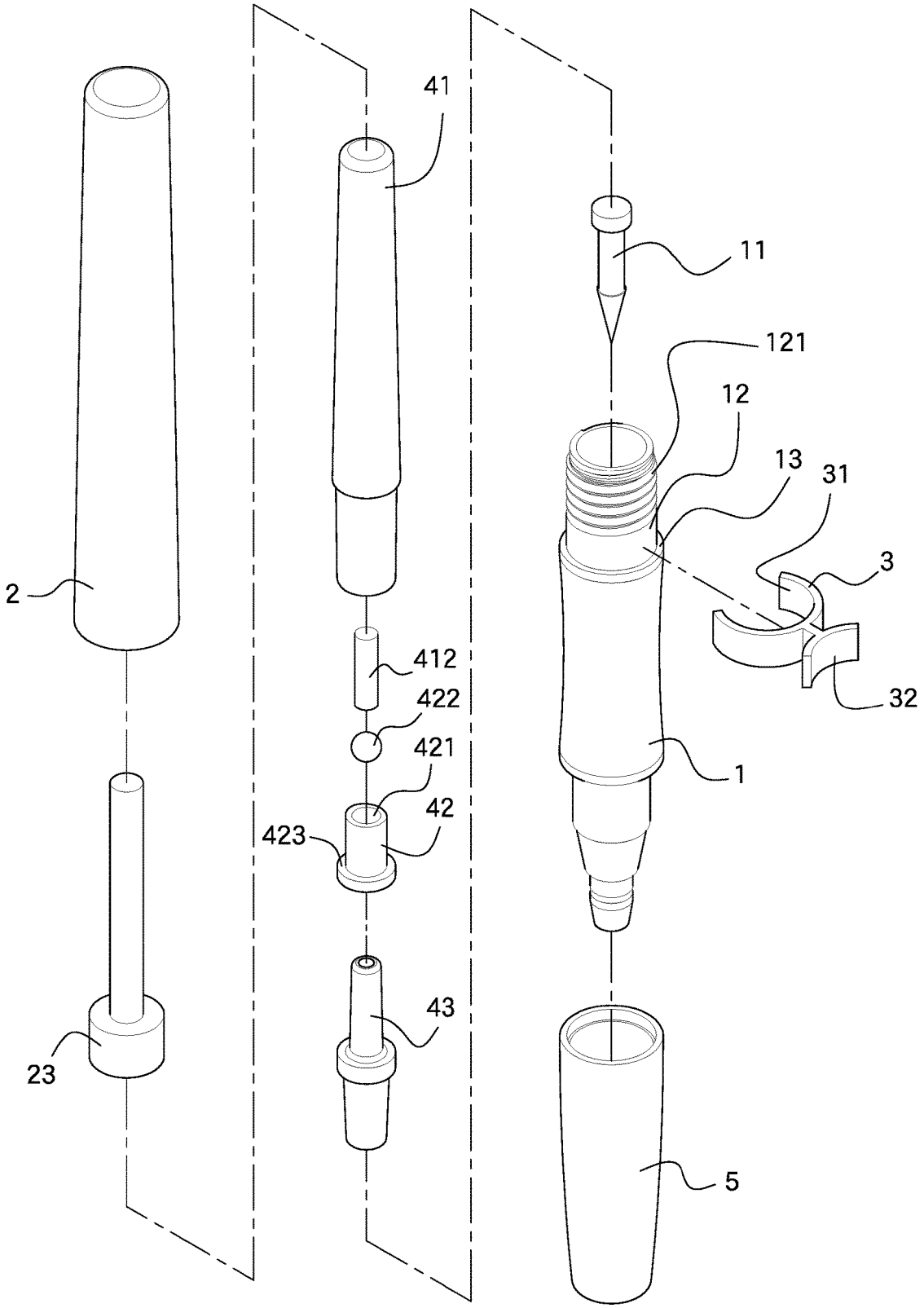
FIG. 2 is an exploded view of the cosmetic applicator of the present invention.
Figure 3:
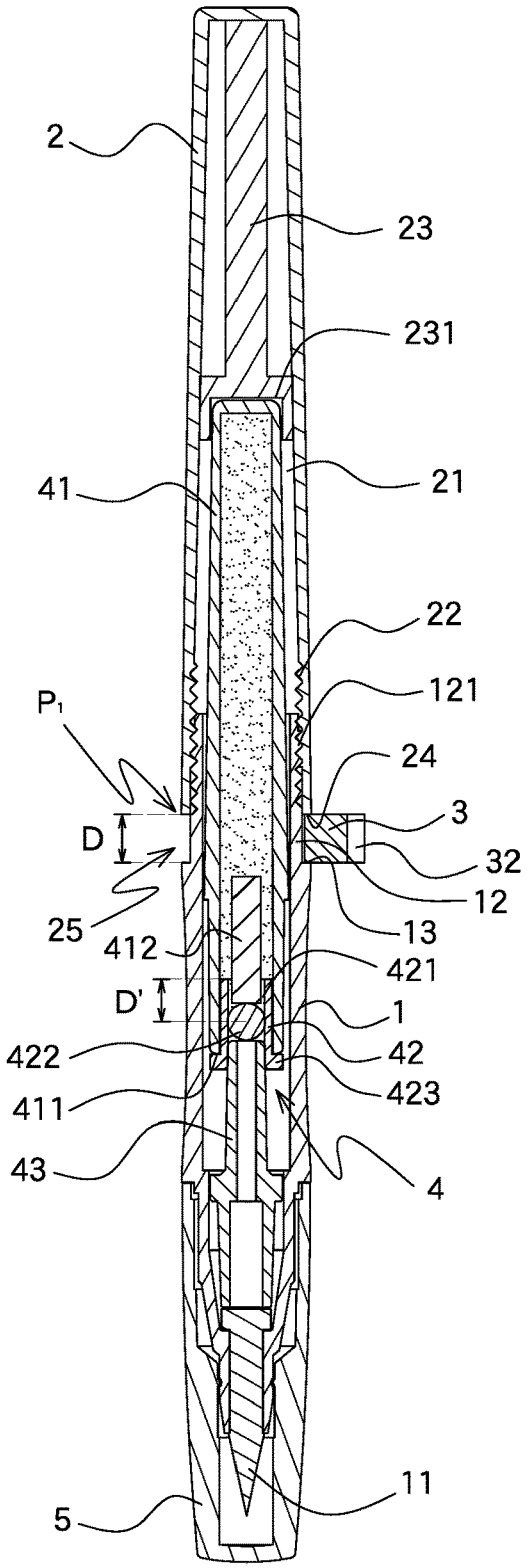
FIG. 3 is a side cross sectional view of the cosmetic applicator of the present invention.

Referring to FIGS. 1 to 3, the cosmetic applicator of the present invention comprises a body 1 having a space defined axially therein. A tip part 11 is connected to the first end of the body 1, and an extension 12 extends from the second end of the body 1 and has a threaded portion 121 formed thereon. The body 1 has a shoulder 13 formed at the conjunction portion between the extension 12 and the body 1. The diameter of the shoulder 13 is larger than that of the threaded portion 121.

A case 2 is connected to the body 1 and has a room 21 which communicates with the space of the body 1. A rotary member 22 is threadedly connected to the threaded portion 121 of the body 1. A contact member 23 is received in the room 21 of the case 2. In this embodiment, the contact member 23 is a T-shaped member. The case 2 has a contact portion 24 which is located corresponding to the shoulder 13 of the body 1. In a preferred embodiment, the contact member 23 and the case 2 are a one-piece part. In a preferred embodiment, a groove 25 is formed between the shoulder 13, the contact portion 24 and the extension 12. A clip 3 is engaged with the groove 25 and has a hold portion 31 which matches with the outer periphery of the extension 12 to connect the clip 3 to the extension 12. In a preferred embodiment, the clip 3 is a C-shaped clip. The top face and the bottom face of the hold portion 31 respectively contact the shoulder 13 and the contact portion 24. The clip 3 has a handle 32 extending from the outside of the hold portion 31.

A liquid supply unit 4 is axially received in the space of the body 1 and the room 21 of the body 2. The liquid supply unit 4 has a liquid tube 41, a duct 42 and a guide tube 43. The liquid tube 41 has the first end thereof contacting the contact member 23. The liquid tube 41 and the duct 42 are received in the room 21 of the case 2. The guide tube 43 is located in the space of the body 1. The contact member 23 has a recess 231 in which the liquid tube 41 is inserted.

The duct 42 is inserted in an opening 411 defined in the first end of the liquid tube 41, and the flange 423 contacts the first end having the opening 411 of the liquid tube 41. The duct 42 has a passage 421 defined axially therethrough. A sealing member 422 is received in the duct 42 and removably located at the first end of the duct 42 that faces the first end of the liquid tube 41. The diameter of the sealing member 422 is larger than an opening in the second end of the guide tube 43, so as to seal or open the guide tube 43. The liquid tube 41 has a rod 412, and the diameter of the rod 412 is smaller than the inner diameter of the passage 421.

The tip part 11 is connected to the first end of the guide tube 43, and the diameter of the second end of the guide tube 43 is smaller than the inner diameter of the passage 421. The second end of the guide tube 43 is located in to the passage 421. The second end of the guide tube 43 contacts the sealing member 422. The guide tube 43 is longer than the duct 42. A cap 5 is axially connected to the first end of the body 1.

Because the conventional cosmetic applicator is easily rotated or pushed unintentionally when the cosmetic applicator is not in use, and releases too much cosmetic liquid as a result, the present invention is structured to eliminate that shortcoming. As shown in FIG. 3, the clip 3 is engaged with the groove 25 between the body 1 and the case 2 to function as a safety device and prevent the user from unintentionally rotating or pushing the cosmetic applicator. The fist time the cosmetic applicator is used, the clip 3 is removed from the groove 25 by pulling the handle 32 outward, and the case 2 is rotated by rotating the rotary member 22 along the threaded portion 121. The body 1 is located at an initial position P1, and the sealing member 422 seals the second end of the guide tube 43.

Figure 4:
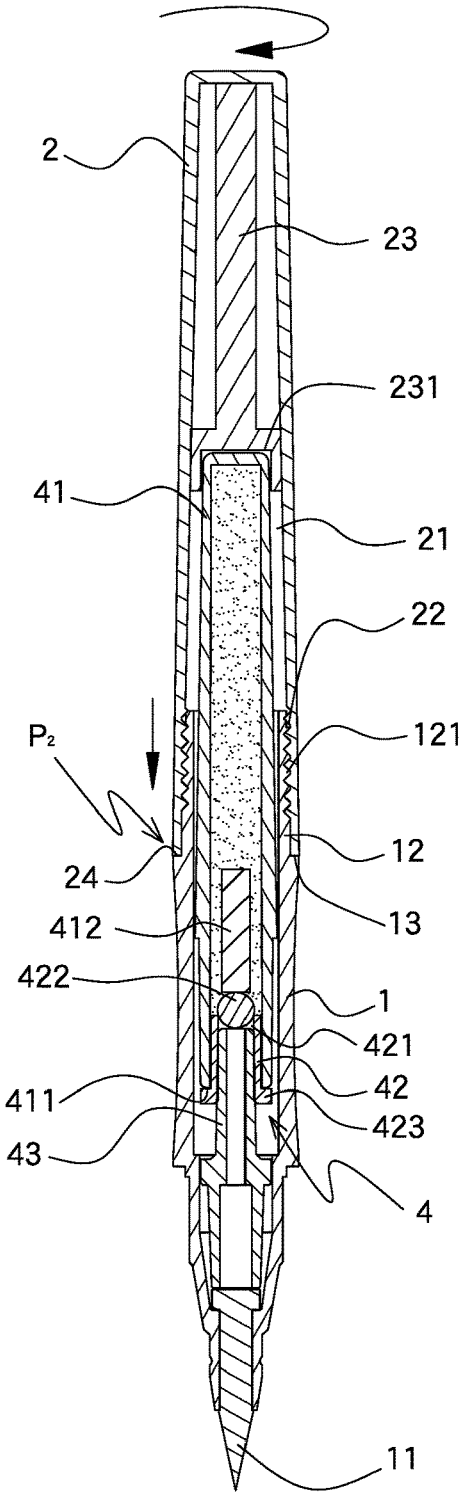
FIG. 4 is a side cross sectional view to show that the case is located at the initial position of the cosmetic applicator of the present invention.

As shown in FIG. 4, when the case 2 is rotated by rotating the rotary member 22 along the threaded portion 121 to make the distance D between the shoulder 13 and the contact portion 24 be reduced to an open position P2, because the liquid tube 41 is contacts the inner end of the recess 231, and the flange 423 of the duct 42 contacts the first end of the liquid tube 41 having the opening 411, so that the when the case 2 is rotated to move toward the tip part 11, the contact member 23 contacts the liquid tube 41 to move the liquid tube 41 and the duct 42 move axially toward the tip part 11. At the same time, the guide tube 43 is inserted into the passage 421, the sealing member 422 is pushed by the second end of the guide tube 43 to move axially in the passage 421. The distance D between the shoulder 13 and the contact portion 24 is larger than the distance D' that the sealing member 422 is separated from the passage 421 of the duct 42. The sealing member 422 moves a distance longer than the distance D' by the guide tube 43 and is located in the liquid tube 41.

Figure 5:
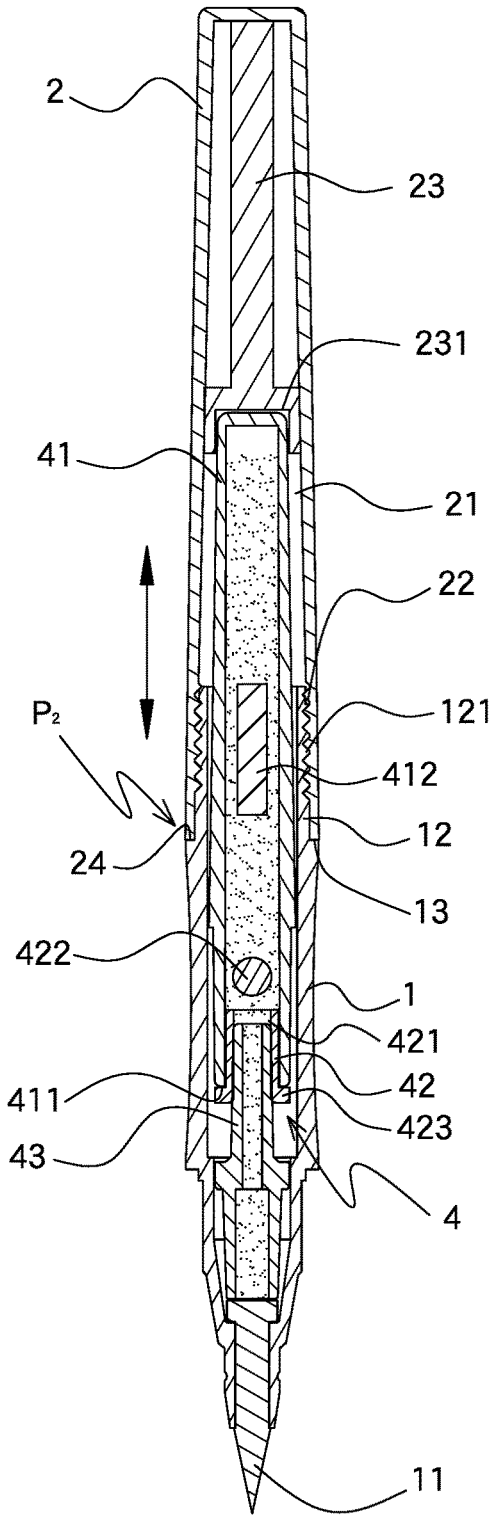
FIG. 5 is a side cross sectional view to show that the case is located at the open position and the cosmetic applicator of the present invention is moved up and down.

As shown in FIG. 5, by shaking the cosmetic applicator of the present invention, the rod 412 stirs the cosmetic liquid in the liquid tube 41, and the sealing member 422 is displaced from the second end of the guide tube 43 due to the shaking, so that the cosmetic liquid in the liquid tube 41 flows through the gap between the sealing member 422 and the duct 42, and flows to the tip part 11 via the guide tube 43. The cosmetic liquid is evenly and smoothly output from the tip part 11 because the rod 412 and the sealing member 422 stir the cosmetic liquid.

After the cosmetic applicator is used, the cap 5 is recapped to the first end of the body 1 to hide the tip part 11 in the cap 5. When the cosmetic applicator is put horizontally or vertically, because the cosmetic liquid has viscosity so that the cosmetic liquid is stably received in the liquid supply unit 4 and the tip part 11 and does not flow. When the cosmetic applicator is used again, by shaking the cosmetic applicator to make the sealing member 422 is displaced from the second end of the guide tube 43, and the rod 412 and the sealing member 422 stir the cosmetic liquid that is gradually subsided, and the cosmetic liquid in the liquid tube 41 flows through the gap between the sealing member 422 and the duct 42, and flows to the tip part 11 via the guide tube 43 for being evenly used.

While we have shown and described the embodiment in accordance with the present invention, it should be clear to those skilled in the art that further embodiments may be made without departing from the scope of the present invention.

What is claimed is:

1. A cosmetic applicator comprising:

a body (1) having a space defined axially therein, a tip part (11) connected to a first end of the body (1), an extension (12) extending from a second end of the body (1) and having a threaded portion (121) formed thereon, the body (1) having a shoulder (13) formed at a conjunction portion between the extension (12) and the body (1), a diameter of the shoulder (13) being larger than that of the threaded portion (121);

a case (2) connected to the body (1) and having a room (21) which communicates with the space of the body (1), a rotary member (22) threadedly connected to the threaded portion (121) of the body (1), a contact member (23) received in the room (21) of the case (2) and being a T-shaped member, the case (2) having a contact portion (24) which is located corresponding to the shoulder (13) of the body (1);

a liquid supply unit (4) axially received in the space of the body (1) and the room (21) of the body (2), the liquid supply unit (4) having a liquid tube (41), a duct (42) and a guide tube (43) having opposing first and second ends, the liquid tube (41) having a first end contacting the contact member (23), the guide tube (43) located in the space of the body (1), the duct (42) being inserted in an opening (411) defined in the first end of the liquid tube (41), the duct (42) having a passage (421) defined axially therethrough, a sealing member (422) being removably located at a first end of the duct (42) that faces the first end of the liquid tube (41), a diameter of the sealing member (422) being larger than an opening in the second end of the guide tube (43) so as to seal or open the guide tube (43), and the tip part (11) connected to the first end of the guide tube (43), a diameter of a second end of the guide tube (43) being smaller than an inner diameter of the passage (421), the second end of the guide tube (43) being located in the passage (421), the second end of the guide tube (43) contacting the sealing member (422), the guide tube (43) being longer than the duct (42), when the body (1) is located at an initial position (P1), the sealing member (422) seals the guide tube (43), when the case (2) is rotated by rotating the rotary member (22) along the threaded portion (121), and a distance (D) between the shoulder (13) and the contact portion (24) is reduced to an open position (P2), the sealing member (422) is pushed by the guide tube (43) and separated from the duct (42), and located in the liquid tube (41).

2. The cosmetic applicator as claimed in claim 1, wherein a groove (25) is formed between the shoulder (13), the contact portion (24) and the extension (12), a clip (3) is engaged with the groove (25) and has a hold portion (31) which matches with an outer periphery of the extension (12) to connect the clip (3) to the extension (12), a top face and a bottom face of the hold portion (31) respectively contact the shoulder (13) and the contact portion (24).

3. The cosmetic applicator as claimed in claim 2, wherein the clip (3) is a C-shaped clip.

4. The cosmetic applicator as claimed in claim 2, wherein the clip (3) has a handle (32) extending from an outside of the hold portion (31).

5. The cosmetic applicator as claimed in claim 1, wherein the contact member (23) and the case (2) are a one-piece part.

6. The cosmetic applicator as claimed in claim 1, wherein the distance (D) between the shoulder (13) and the contact portion (24) is larger than the distance (D') that the sealing member (422) is removed from the passage (421).

7. The cosmetic applicator as claimed in claim 6, wherein the contact member (23) has a recess (231) in which the liquid tube (41) is inserted.

8. The cosmetic applicator as claimed in claim 1, wherein a cap (5) is axially connected to the first end of the body (1), the contact member (23) is axially connected to the body (1).

9. The cosmetic applicator as claimed in claim 1, wherein the liquid tube (41) has a rod (412), a diameter of the rod (412) is smaller than the inner diameter of the passage (421).

10. The cosmetic applicator as claimed in claim 1, wherein the duct (42) has a flange (423) formed on a second end thereof, the flange (423) contacts the opening (411) in the first end of the liquid tube (41).

* * * * *